United States Patent [19]

Ishikawa et al.

[11] 4,448,269

[45] May 15, 1984

[54] CUTTER HEAD FOR PIT-BORING MACHINE

[75] Inventors: Yasuaki Ishikawa, Ami; Shuichi Ajiro; Masami Wada, both of Chiyoda, all of Japan

[73] Assignee: Hitachi Construction Machinery Co., Ltd., Tokyo, Japan

[21] Appl. No.: 315,650

[22] Filed: Oct. 27, 1981

[51] Int. Cl.[3] ..... E21B 10/28; E21B 10/16

[52] U.S. Cl. ..... 175/335; 175/336; 175/376; 175/391; 299/86; 299/90

[58] Field of Search ..... 175/335, 336, 376, 391, 175/334, 390; 299/86, 90

[56] References Cited

U.S. PATENT DOCUMENTS

| | | | |
|---|---|---|---|
| 1,460,671 | 7/1923 | Hebsacker | 299/90 X |
| 3,139,148 | 6/1964 | Robbins | 175/336 |
| 3,379,264 | 4/1968 | Cox | 175/376 X |
| 3,493,165 | 2/1970 | Schonfeld | 299/86 X |

FOREIGN PATENT DOCUMENTS

| | | |
|---|---|---|
| 2319980 | 1/1975 | Fed. Rep. of Germany . |
| 2822501 | 12/1978 | Fed. Rep. of Germany . |

OTHER PUBLICATIONS

Lassen et al., Neue Schachtbautechnik, Gluckauf, vol. 115, No. 9, 1979, p. 383.

Trosken: Erfahrungen etc., Gluckauf, vol. 99, No. 24, p. 1334, 1963.

Technische Umschau, Gluckauf, issue of Jul. 9, 1979, p. 701.

Catalog Alfred Wirth & Co., 1970, pp. 1–11.

Schlagel und Eisen, Apr., 1966, pp. 184–186.

Baumaschine und Bautechnik, Feb. 2, 1957, pp. 41–42.

*Primary Examiner*—Ernest R. Purser

*Assistant Examiner*—Michael Starinsky

*Attorney, Agent, or Firm*—Wenderoth, Lind & Ponack

[57] ABSTRACT

A rotatable cutter head for a pit boring machine used in reverse circulation drilling. The cutter head has cutter arrays including rotary cutters and drag cutters and disposed radially and circumferentially spaced positions on the cutter head, the drag cutters having the cutting ends lying generally in a conical plane having the axis coaxial with the axis of rotation of the cutter head. The rotary cutters each have cutting teeth around the circumference thereof and each tooth has an inclined side face lying in a further conical plane the central axis of which is coaxial with the axis of rotation of the rotary cutter, the inclined side face of each tooth facing generally along the inclination of the conical plane in which the cutting ends of the drag cutters lie, and the tip of each cutting tooth of each rotary cutter projecting beyond the plane in which the cutting ends of the drag cutters lie.

8 Claims, 16 Drawing Figures

13
7
29
VI
28
27
25
24
23
21
VI

CUTTER HEAD FOR PIT-BORING MACHINE

BACKGROUND OF THE INVENTION (a) Field of the invention

The present invention relates to a cutter head of a pit-boring machine, and more particularly it pertains to a cutter head of a boring machine which is used in reverse circulation drilling.

(b) Description of the prior art

The so-called reverse circulation drilling technique is employed in the drilling of pits for driving piles in the construction of buildings. Piles for the construction of large buildings are forced to penetrate into the rock stratum which is beneath the soil layer. The cutter heads of a boring machine have heretofore consisted of two types, one of which is intended for the excavation of soil, and the other is for the drilling of rocks. It has been the practice that the boring of the soil layer and rock stratum is carried out by using a cutter head appropriate for the type of material to be excavated.

SUMMARY OF THE INVENTION

The present invention seeks to provide a cutter head of a pit-boring machine which permits one to carry out boring through the soil layer into the rock stratum without replacement of the cutter head.

The present invention provides a cutter head of a pit-boring machine used in reverse circulation drilling, comprising: cutter arrays including rotary cutters and drag cutters and disposed radially and inclined relative to a vertical axis of said cutter head, said rotary cutters each having, circumferentially thereof, formations of cutting teeth each having an inclined lateral face lying in a conical plane with its central axis coaxial with the axis of rotation of the cutter, said inclined lateral face of each of said cutting teeth facing the direction of the inclination of the mating ones of said cutter arrays and the tip of said cutting tooth of each rotary cutter projecting beyond the line defined by cutting tips of said drag cutters.

In one embodiment of the present invention, a cutter head of a pit-boring machine which is employed in reverse circulation drilling comprises: a hollow open-ended main shaft; supporting members forming acute angles $\alpha$ and $\beta$ relative to a horizontal plane and a vertical plane, respectively, and disposed radially of said main shaft and having an end portion fixed to said the circumference of said main shaft; a pilot cutter provided at one end of said main shaft; a stabilizer supported on the other end of said main shaft; gauge cutters provided on said supporting members at the outermost ends thereof; and cutters attached to said supporting members at intermediate positions between said gauge cutters and said main shaft, said cutters each comprising rotary cutters arranged rotatably on corresponding supporting members at positions progressively away relative to each other from the central axis of said main shaft, and drag cutters fixed to corresponding supporting members at positions close to said rotary cutters and also close to each other, said cutters each being comprised of a disk having on its circumference a formation of teeth each having an inclined side face positioned within a conical plane having the central axis coaxial with the axis of rotation of the mating rotary cutter, the lowermost tooth being disposed so that the distance between said lowermost tooth and the supporting member therefor is greater than the distance between blade tips of the drag cutters and the supporting members therefor.

BRIEF DESCRIPTION OF THE DRAWINGS

FIGS. 10 and 11 are diagrammatic explanatory illustrations partly in section showing the cutters of the cutter head according to the present invention as drilling a rock stratum, in which:

FIG. 10 shows the drilling as viewed from the side of the cutters, and

FIG. 11 shows the drilling along the line XI—XI of the cutter in FIG. 10.

DETAILED DESCRIPTION OF THE PREFERRED EMBODIMENTS

Figure 1:
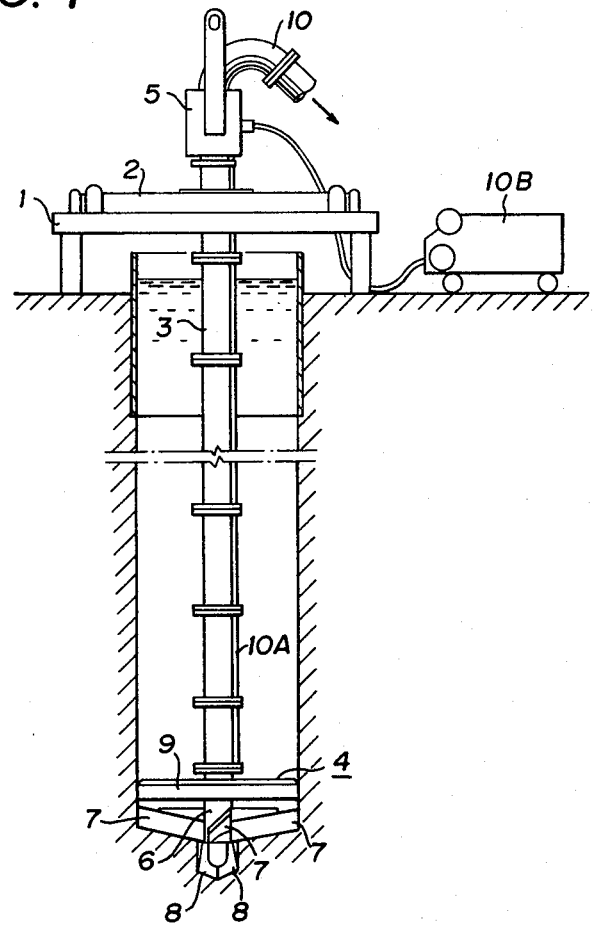
FIG. 1 is an elevation view showing the general construction of a pit-boring machine employed in a reverse circulation drilling method.

The cutter head according to the present invention is incorporated in a boring machine which is operated according to the reverse circulation drilling method. FIG. 1 shows a typical configuration of such a boring machine.

The base frame 1 is installed on the ground surface. A rotary table 2 is supported on the base frame 1. A drilling pipe 3 is mounted on the rotary table 2 for axial movement therethrough. A cutter head 4 is attached to that end portion of the drilling pipe which is located below the ground surface. A swivel joint 5 is mounted at the end portion which is located above the ground surface. The drilling pipe 3 as well as the cutter head 4 are suspended from a crane which is not shown. The cutter head 4 has a main shaft 6 which is connected to the drilling pipe 3. A supporting member or wing 7 is mounted on the main shaft 6. A pilot cutter 8 is fixed to the lowermost end of the main shaft 6. A boring operation is carried out by rotating the rotary table 2 on the base frame 1, and the cutter arrays provided on the supporting members excavate the ground progressively in accordance with the rotation of the rotary table 2, while the drilling pipe 3 together with the cutter head 4 are lowered progressively. During the excavation, the pilot cutter 8 as well as the gauge cutters 20 which are positioned at the outermost periphery of the supporting member serve to prevent any eccentric rotation of the cutter head 4, and concurrently a stabilizer 9 guides the cutter head 4 so as to bore a pit without deviation.

In order to discharge pieces of soil and the like out of the pit, a discharge pipe 10 is connected to the top end of the drilling pipe 3 via the swivel joint 5, and an air supply pipe 10A is connected to the drilling pipe 3. Discharge of soil pieces and rock chips is carried out by supplying compressed air which is supplied from an air compressor 10B installed on the ground surface into the air supply pipe 10A for injection in a jet into the drilling pipe 3, and by virtue of the action of this jet of compressed air, soil pieces and rock chips which have been produced due to the drilling of the pit are sucked, together with the water present in the pit, into the hollow main shaft of the cutter head, and they are discharged, through the drilling pipe 3, to the surface of the ground. Besides the airlift drilling described above, it should be understood that the discharge may be performed by a suction pump connected to the discharge pipe, instead of the air compressor and air supply pipe, i.e. pump suction drilling.

Figure 2:
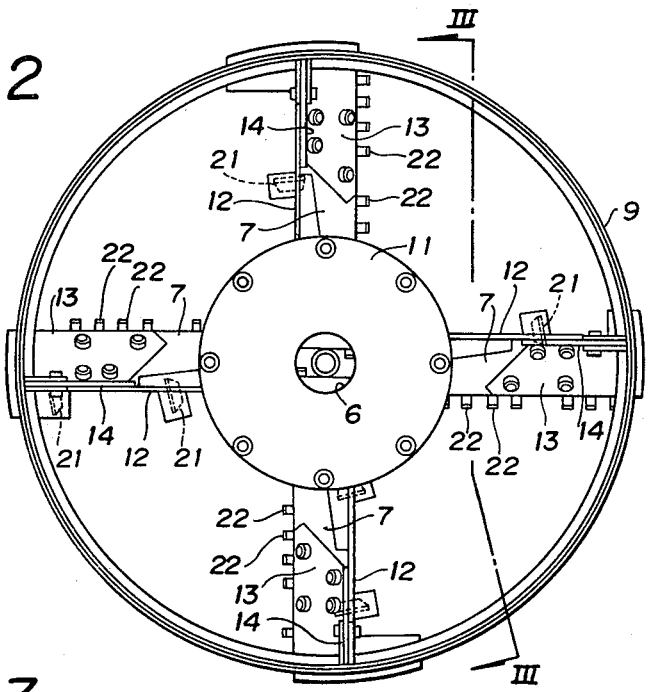
FIG. 2 is a plan view of the cutter head according to the present invention.
Figure 3:
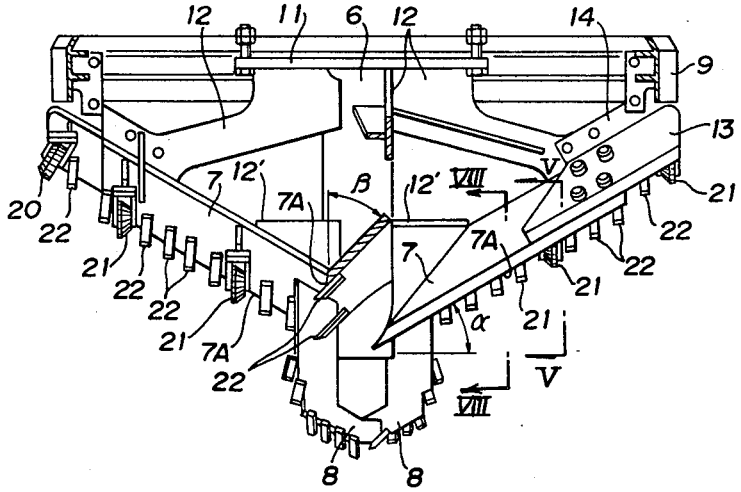
FIG. 3 is a side elevational view of the cutter head of the present invention partly in section along the line III—III in FIG. 2.
Figure 4:
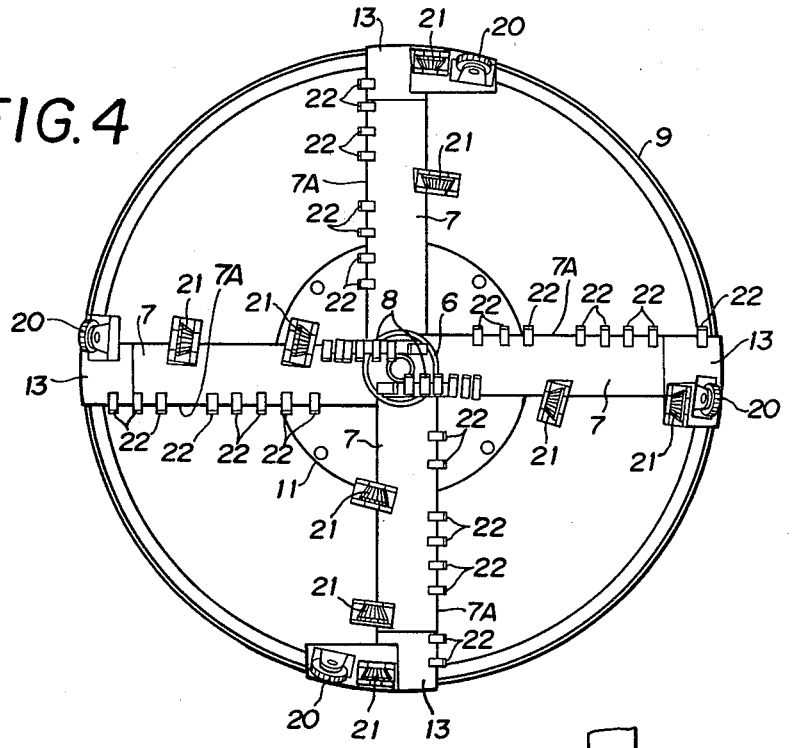
FIG. 4 is a diagrammatic bottom view of the cutter head of the present invention.

FIGS. 2 to 4 show the details of the cutter head of the present invention. The main shaft 6 is comprised of a hollow open-ended pipe, and has a flange 11 provided at the top thereof, and this flange is connected, by means of bolts, to a flange which is provided at the bottom end of the drilling pipe 3. The supporting m nbers 7 are each at an acute angle $\alpha$ relative to a horizontal plane, and also are at an acute angle $\beta$ relative to a vertical plane. These supporting members 7 are disposed radially of the central axis of rotation of the main shaft 6. The end portions of these supporting members 7 are welded to the circumference of the main shaft 6. Reinforcement plates 12 and 12' respectively couple the free ends of the supporting members 7 to the circumference of the main shaft 6, and couple the fixed ends of the supporting members 7 to the circumference of the main shaft 6. Both the supporting member 7 and the reinforcement plate 12 have their own extensions 13 and 14, respectively, which are coupled to the supporting member 7 and to the reinforcement plate 12 by bolts, respectively, so that these supporting members 7 and the reinforcement plates 12 can be dismantled for the transportation of the whole cutter system. A stabilizer 9 is coupled integrally to these extensions.

Gauge cutter 20 are disposed at uniform intervals on the outermost peripheries of the respective supporting members 7. Each gauge cutter is a rotatable disk having teeth on the circumference thereof each having a slanted lateral face positioned within a conical plane coaxial with the axis of rotation of the gauge cutter, and being disposed on the corresponding supporting member with said slanted lateral faces of said teeth at the radially outermost portion of each gauge cutter parallel with the axis of said main shaft. Cutter arrays are provided on the supporting members 7 between the gauge cutters 20 and the main shaft 6. Each cutter array is comprised of rotary cutter means, which in this embodiment is a single rotary cutter 21, and drag picks or drag cutters 22. Each rotary cutter 21 is attached to its mating supporting member 7 for free rotation, and each drag cutter 22 is fixed to its mating supporting member 7 by welding.

Figure 6:
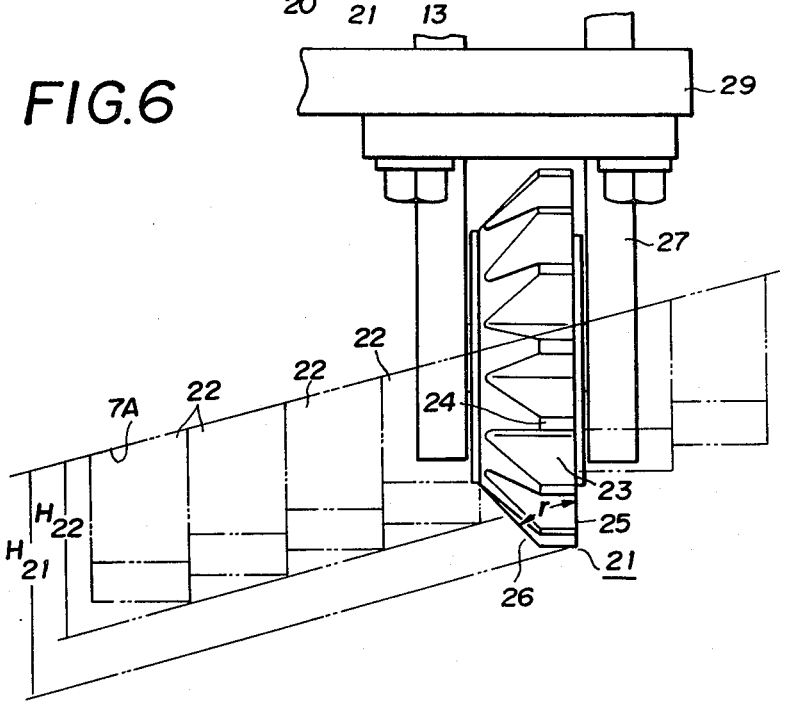
FIG. 6 is a front view of the rotary cutter, partly in section taken along the line VI—VI in FIG. 5, showing also its position relative to the drag cutter.
Figure 5:
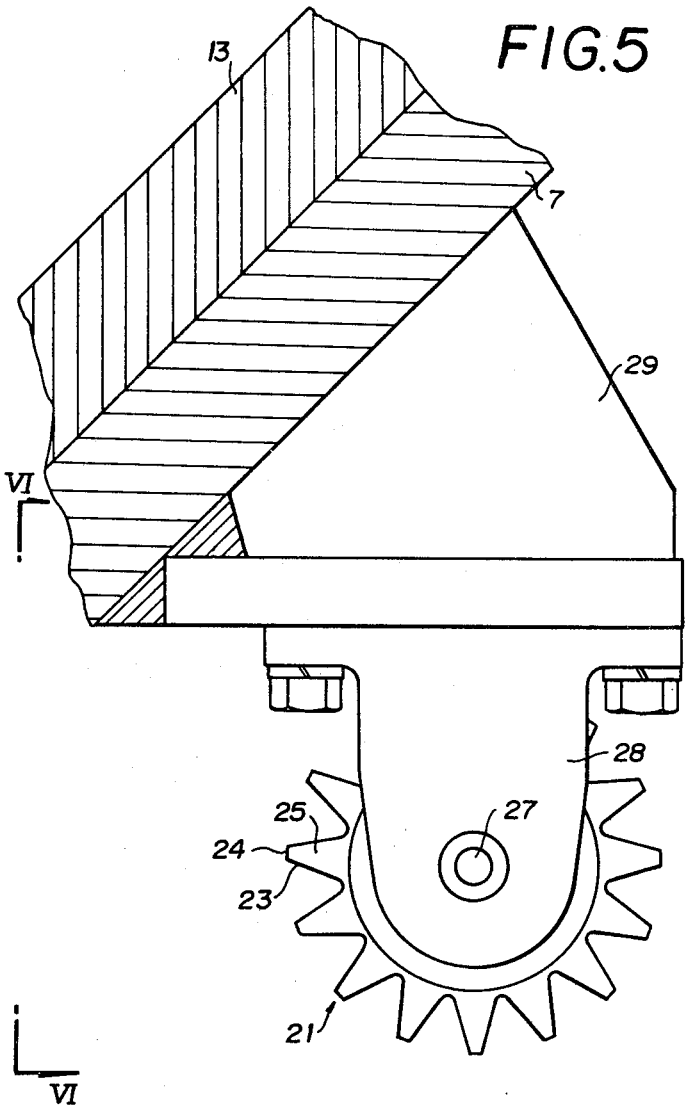
FIG. 5 is an enlarged side elevation of a rotary cutter in the cutter head of the present invention, taken along the line V—V in FIG. 3.

As best shown in FIGS. 5 and 6, each rotary cutter 21 is formed of a disk having substantially triangular or frustum shaped cutting teeth 23 formed circumferentially thereof. These cutting teeth are arranged radially relative to the central axis of rotation of the rotary cutter 21. The tip 24 of each cutting tooth is positioned in a circle parallel with the central axis of the rotary cutter 21, or on a cylindrical face having the central axis coaxial with the central axis or rotation of said rotary cutter. One lateral face 25 of each cutting tooth is formed as a flat face which crosses said central axis of the rotary cutter 21 at a right angle. The other side face thereof is slanted to provide an inclined face 26. Such inclined face 26 is disposed in a conical plane having its apex located on the central axis of rotation of the rotary cutter 21. The angle $\gamma$ formed by the inclined face 26 of each cutting tooth relative the plane perpendicular to the central axis of rotation of the rotary cutter or to the lateral face 25, desirably, is selected to be within the range of 15° to 45°.

The exact dimensions of the respective portions of a preferred embodiment of the rotary cutter are as follows. The diameter (distance from blade tip to blade tip) of the rotary cutter is 175 mm, the width thereof is 55 mm, the number of cutting teeth is 13, and the angle formed by the faces of adjacent cutting teeth, i.e. the acute angle of the groove between such teeth is 63°42', the central axial length at the tip of the blade or tooth is 10 mm, the width of the tip of the tooth is 2 mm, and the angle of the slanting face of the tooth, i.e. the aforesaid angle $\gamma$, is 35°54'.

As described above, the respective rotary cutters 21 are attached to their mating supporting members 7 for free rotation. To this end, the respective rotary cutters 21 are each mounted on a shaft 27 via a bearing. This shaft 27, in turn, is fixed to a supporting stud 28 which is coupled, by bolts, to a base 29 which, in turn, is fixed by welding to the mating supporting member 7.

Each rotary cutter 21 is disposed, in general, in such manner that the slanting sides of the cutting teeth face the direction of inclination of the supporting member 7. And, each rotary cutter 21 is arranged so that its central axis passes through the central axis of rotation of the cutter head 4. However, as will be described later, it is preferred that each rotary cutter 21 be arranged so that its central axis of rotation is offset relative to a rectilinear line passing through the central axis of rotation of the cutter head 4.

Figure 7:
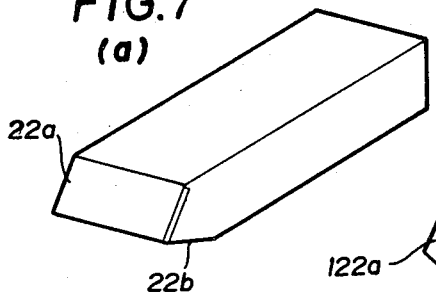
FIGS. 7(*a*) to (*d*) are diagrammatic perspective views of some examples of a drag cutter which can be used in the cutter head of the present invention.
Figure 7:
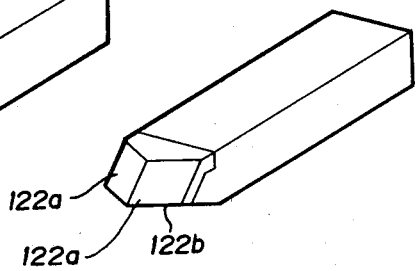
Figure 7:
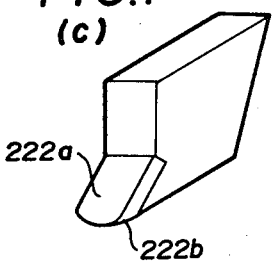
Figure 7:
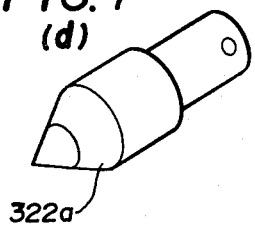
Figure 8:
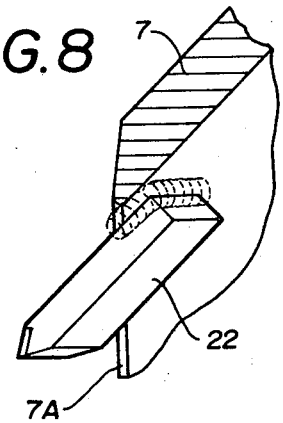
FIG. 8 is an enlarged side elevation of the drag cutter taken along the line VIII—VIII in FIG. 3.

A drag cutter or drag pick can be of any known type. For example, it can have a chisel-like blade tip, which is a more complicated shape. Alternatively, the blade tip can have a conical end shape. Such blades are used either independently or in a desired combination. FIGS. 7(*a*) to (*c*) show some examples of chisel-like drag cutters. The drag cutter shown in FIG. 7(*a*) is very close to a chisel, and has a flat scooping-up face 22*a* and a flat escaping face 22*b*. The drag cutter shown in FIG. 7(*b*) has its scooping-up face 122*a* having an inverted V shape or an inverted roof shape, whereby an escape face is formed laterally. The escape face 122*b* has a flat shape. The drag cutter shown in FIG. 7(*c*) has a flat scooping face 222*a*, but the escape face 222*b* is curved. FIG. 7(*d*) shows a drag cutter having a conical end type blade tip, and this blade tip portion 322*a* is arranged so as to be able to rotate around the shank. Each drag cutter, as best shown in FIG. 8, is attached to the supporting member 7 by fixing, by welding for example, that portion thereof which is located away from the blade tip onto the supporting member 7.

Each rotary cutter 21 is arranged so that the blade tip 24 which is located lowermost is positioned on a plane crossing the center of rotation of the main shaft 6 perpendicularly. Each drag cutter 22 also is disposed so that the blade tip is positioned on a plane crossing the central axis of rotation of the main shaft 6 perpendicularly. Accordingly, the tips of the cutting teeth of the rotary cutters as well as the blade tips of the drag cutters of respective arrays are positioned so as to cross the central axis of rotation of the main shaft 6 perpendicularly and also so that they are positioned on planes extending parallel with the central axis of rotation of the main shaft or the excavated surface of ground. In the cutter head of the present invention, however, all of the rotary cutters are arranged so that the distance $H_{21}$ from the tip of the lowermost cutting tooth up to the lowermost edge 7A of the mating supporting member 7, i.e. the distance in a direction parallel with the central axis of rotation of the cutter head, is greater than the distance $H_{22}$ between the blade tip of each of the drag cutters up to the bottom edge of the mating supporting member. Thus, the respective cutters are arranged so that, at the time of boring, the rotary cutters are brought into contact with the ground surface first, and subsequently the drag cutters are brought into contact with the ground surface.

A plurality of drag cutters, e.g. four drag cutters, are disposed adjacent to a rotary cutter. These drag cutters are disposed in close contact with the mating rotary cutter and also in close contact with each other, and may partially overlap each other as required.

Figure 9:
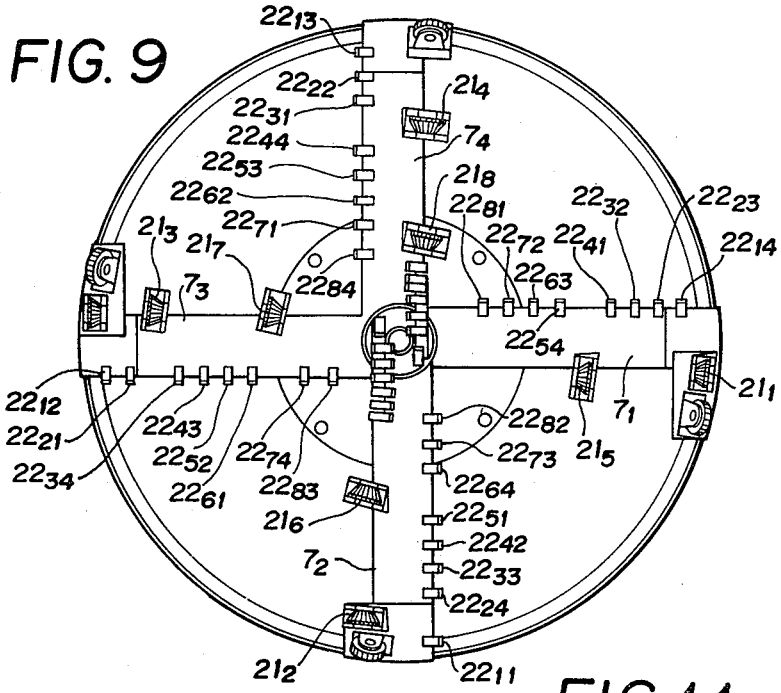
FIG. 9 is a diagrammatic plan view of the rotary cutters and the drag cutters in the cutter head of the present invention.

In order to prevent the space between adjacent cutters from being blocked with soil and chips of rocks, and also to facilitate the attachment of cutters to their mating supporting members, it should be noted that the rotary cutters and the drag cutters are spaced from each other in different arrangements on the respective supporting members. FIG. 9 shows the details of arrangement of the cutters. Respective supporting members, rotary cutters and drag cutters are indicated by a reference number with suffix numerals. The drag cutter which is next inward from the rotary cutter $21_1$ on the supporting member $7_1$ is the drag cutter $22_{11}$ provided on the supporting member $7_2$. The drag cutter which is next inward from the drag cutter $22_{11}$ is the drag cutter $22_{12}$ on the supporting member $7_3$. The drag cutter which is next inward from the drag cutter $22_{12}$ is the drag cutter $22_{13}$ on the supporting member $7_4$. The drag cutter which is next inward from the drag cutter $22_{13}$ is the drag cutter $22_{14}$ supported on the supporting member $7_1$. As described, the drag cutters are supported on their mating supporting members. Furthermore, the rotary cutter $21_2$ on the supporting member $7_2$ is disposed so as to be next inward from the drag cutter $22_{14}$. Also, the drag cutter $22_{21}$ on the supporting member $7_3$, the drag cutter $22_{22}$ on the supporting member $7_4$, the drag cutter $22_{23}$ on the supporting member $7_1$, and the drag cutter $22_{24}$ on the supporting member $7_2$ are disposed next inward relative to each other in this order. Similarly, the rotary cutter $21_3$ on the supporting member $7_3$ is disposed on the mating supporting member so as to be next inward from the drag cutter $22_{24}$, and the drag cutters $22_{31}$, $22_{32}$, $22_{33}$ and $22_{34}$ are disposed successively farther inward; the rotary cutter $21_4$ is disposed next inward to drag cutter $22_{34}$, and drag cutter $22_{41}$, $22_{42}$, $22_{43}$ and $22_{44}$ are disposed successively farther inward; the rotary cutter $21_5$ is next inward to drag cutter $22_{44}$, and drag cutters $22_{51}$, $22_{52}$, $22_{53}$ and $22_{54}$ are disposed successively farther inward; the rotary cutter $21_6$ is next inward to drag cutter $22_{54}$, and drag cutters $22_{61}$, $22_{62}$, $22_{63}$ and $22_{64}$ are disposed successively farther inward; the rotary cutter $21_7$ is next inward to drag cutter $22_{64}$, and drag cutters $22_{71}$, $22_{72}$, $22_{73}$ and $22_{74}$ are disposed successively farther inward; and the rotary cutter $21_8$ is next inward to drag cutter $22_{74}$ and drag cutters $22_{81}$, $22_{82}$, $22_{83}$ and $22_{84}$ are disposed successively farther inward, respectively, on their mating supporting members. Among those drag cutters for the respective rotary cutters, the innermostly located drag cutters also are disposed next outwardly from respective next adjacent rotary cutters in the circumferential direction. In the drawings, the drag cutter $22_{14}$ and the rotary cutter $21_2$, the drag cutter $22_{24}$ and the rotary cutter $21_5$, the drag cutter $22_{54}$ and the rotary cutter $21_6$, the drag cutter $22_{64}$ and the rotary cutter $21_7$, and the drag cutter $22_{74}$ and the rotary cutter $21_8$ which respectively succeed each other circumferentially are disposed so as to be close to each other in the radial direction. Thus the cutters are disposed on a spiral line from the periphery of the cutter head to the center along a conical plane with groups of a plurality of drag cutters between each pair of rotary cutters. As such, rotary cutters are disposed at greater distances from the central axis of rotation of the cutter head 4. The drag cutters, on the other hand, are disposed so as to be between adjacent rotary cutters in the circumferential direction at greater distances from the central axis of rotation of the cutter head.

Such configuration of the rotary cutters and the arrangement of both the rotary cutters and the drag cutters will provide the below-described boring effect. That is, as the cutter head is moved downwardly while being rotated, the rotary cutters which are being rotated will excavate the ground, and then the drag cutters in the successive groups will cut those portions of soil which have been left uncut by the rotary cutters. By repeating these operations, boring will progress to produce a pit.

Figure 10:
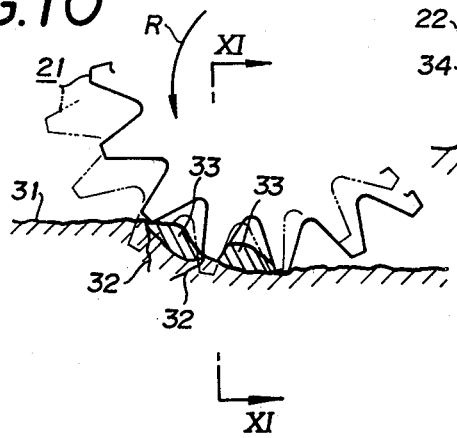
Figure 11:
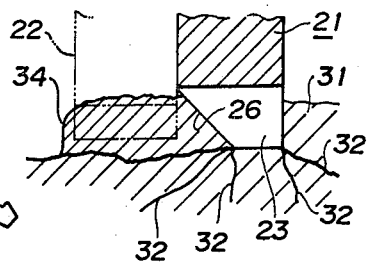

FIGS. 10 and 11 show the manner of excavation of rocks. The cutter head, as described above, is subjected to a vertical load during excavation. Therefore, rotary cutters 21 are forced to penerate into the rocks 31 ahead of the drag cutters 22, and cause cracks 32 in the rocks. Concurrently therewith, rotary cutters will serve to develop shears in rocks by the slant side surfaces 26 of the rotary cutters. At the same time, the rotary cutters are caused to rotate in the direction of arrow R in accordance with the rotation of the main shaft. The rotating rotary cutters serve to cut, by their blades, rocks, and feed cut chips 33 of rocks rearwardly through the grooves defined between respective teeth thereof. As the rotation of the cutter head progresses further, drag cutters 22 will cut those rocks 34 loosened by the abovesaid development of cracks caused by the rotary cutters. By repetition of these operations, the rock stratum is bored. The loosening of, the rocks by the rotary cutter reaches no farther than to the extension of excavation performed by the adjacent drag cutter and also to the lateral face of that drag cutter located next to an adjacent drag cutter. However, the extension of excavation done by the third and the fourth drag cutters in each group is loosened by a next-positioned rotary cutter.

On the other hand, in ordinary soil stratum, the rotary cutters first push aside the soil masses by their inclined lateral faces to thereby loosen the soil masses, and at the same time therewith, they drill soil masses by their cutting teeth. Then, the drag cutters are able to cut the thus loosened soil masses successively.

The cutter head according to the present invention is capable of conducting excavation of ground, irrespective of whether it is soil or rocks, without requiring replacement of the cutter head. Not only that, because the drag cutters cut the ground loosened by the rotary cutters, it is possible to minimize the drilling resistance to which the drag cutters are subjected. Moreover, the rotary cutters perform excavation while rotating. Therefore, the drilling resistance of the rotary cutters is also small. As a result, the overall drilling resistance of the cutter head can be reduced, and power can be saved. Moreover, it is possible to extend the service life of the cutter head.

Figure 12:
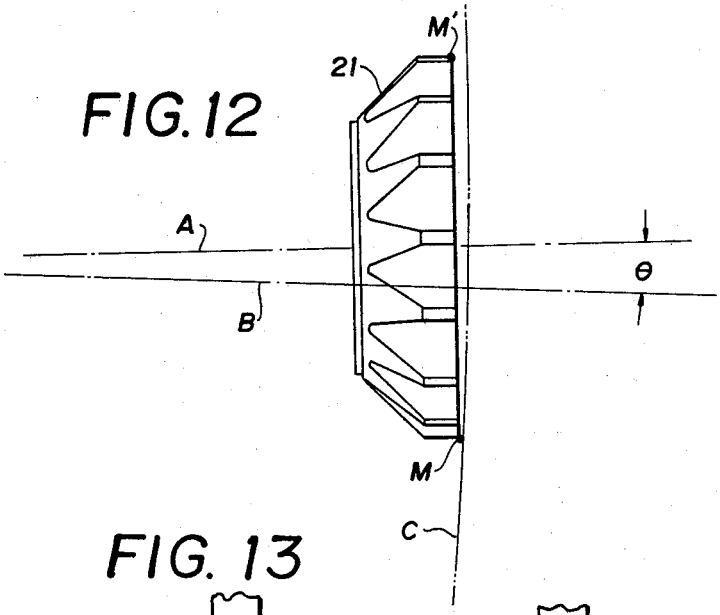
FIG. 12 is a diagrammatic illustration showing the positional relationship of a rotary cutter relative to the central axis of rotation of the cutter head of the present invention.

In order to further extend the service life of the rotary cutters, it is preferred to arrange the rotary cutters so that, as described above, the central axes of the respective rotary cutters are offset with respect to a radius extending at a right angle from the central axis of rotation of the cutter head. FIG. 12 shows such arrangement in detail. The rotary cutter is arranged so that its central rotation axis A is at an angle $\theta$ relative to the radius B which extends from the central axis of rotation of the cutter head at a right angle, and which angle $\theta$ lies in a plane perpendicular to the axis of rotation of the cutter head. Thus, only the point M of the flat lateral face of the cutting tooth which is forced into the soil or ground is brought into contact with the excavated soil or ground, and the closer to the point M' from said point M, the farther flat lateral face of tooth will depart from the side wall face C of the excavated ground. As a result, those cutting teeth other than the tooth or teeth which participate in the excavation of soil are prevented from being repetitively brought into contact with the already excavated soil. Thus, the service life of the rotary cutter can be improved. The angle $\theta$, desirably, is selected in the range of 0.5°–10° in general.

In the cutter head according to the present invention, the gauge cutter which is positioned farthest outwardly of the central axis of rotation of the cutter head also is a disk having, like the rotary cutter, cutting teeth each provided with a slanted lateral face formed on the circumference of the gauge cutter. The distance between the lowermost cutting tooth and the bottom edge of the supporting member is identical to the rotary cutter. However, the slanted lateral face thereof is positioned on a vertical plane.

In the boring operation, such gauge cutter, in cooperation with the pilot cutter, prevents the deviation of the central axis of the cutter head during excavation. Also, it is possible to perform the boring while loosening the walls defining a pitch which is being excavated.

Figure 13:
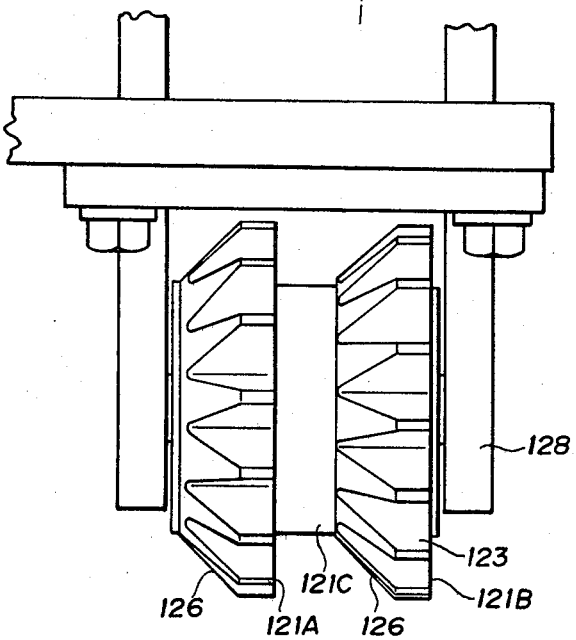
FIG. 13 is a front elevation view showing another structure of the rotary cutter in the cutter head of the present invention.

In the cutter head according to the present invention, the rotary cutter means may be comprised of a plurality of rotary cutters which are disposed coaxially. FIG. 13 shows a concrete arrangement of such rotary cutter means. The rotary cutter 121A and the rotary cutter 121B have an identical structure, and they are formed integrally on a single shank 121C. A shaft is fixed to a supporting stud 128. The rotary cutters are attached to this shaft by their common shank 121C via a bearing.

Also, the rotary cutters are such that those which are positioned close to the main shaft, that is, for example the rotary cutters indicated at $\mathbf{21_6}$, $\mathbf{21_7}$ and $\mathbf{21_8}$ in FIG. 9, may each be constituted by a solid disk having a pointed circumference which is widely used, to thereby reduce the manufacturing cost.

What is claimed is:

1. A rotatable cutter head for a pit boring machine used in reverse circulation drilling, comprising:

cutter arrays each including a rotary cutter means and a plurality of drag cutters disposed at circumferentially spaced positions on said cutter head, said drag cutters having the cutting ends lying generally in a conical plane having the axis coaxial with the axis of rotation of said cutter head, said cutter arrays lying along a spiral line on said conical plane in which the cutting ends of said drag cutters lie and extending from the outer circumferential edge of said plane to the center of said plane, the drag cutters succeeding the rotary cutter means in each array, the respective rotary cutter means having the axes of rotation thereof at an acute angle relative to a radius perpendicular to the axis of rotation of the cutter head, said angle lying in a plane perpendicular to the axis of the cutter head, said rotary cutter means each having cutting teeth around the circumference thereof and the tip of each cutting tooth of each rotary cutter means projecting beyond the plane in which the cutting ends of said drag cutters lie.

2. A cutter head as claimed in claim 1 in which each tooth has an inclined side face lying in a further conical plane the central axis of which is coaxial with the axis of rotation of said rotary cutter means, said inclined side face of each tooth facing generally along the inclination of the firstmentioned conical plane in which the cutting ends of the drag cutters lie.

3. A cutter head for a pit boring machine which is employed in reverse circulation drilling, comprising:

a hollow open-ended main shaft;

a pilot cutter at one end of said main shaft;

supporting members spaced at intervals around said main shaft and each having one end fixed to the circumference of said main shaft and extending radially of said main shaft and away from said one end of said main shaft at an angle $\alpha$ relative to a line perpendicular to the axis of said main shaft and at an acute angle $\beta$ to the axis of said main shaft;

a stabilizer at the other end of said main shaft and connected to the outer portions of said supporting members;

gauge cutters on the outermost ends of said supporting members; and cutters attached to said supporting members at intermediate positions between said gauge cutters and said main shaft, said cutters comprising rotary cutter means rotatably mounted on the supporting members and drag cutters fixedly mounted on said supporting members, said rotary cutter means and drag cutters lying along a spiral line along a conical plane defined by the edges of said supporting members facing toward said one end of said main shaft and extending from the outer ends of said supporting members to said main shaft, said rotary cutter means each being at least one disk having teeth on the circumference each having the ends toward said one end at a distance from the supporting member on which it is mounted which is greater than the distance between tips of the drag cutters and the supporting member on which they are mounted, said rotary cutter means each having the axis of rotation at an acute angle $\theta$ relative to a radius perpendicular to the axis of said main shaft, said angle lying in a plane perpendicular to the axis of the cutter head.

4. A cutter head according to claim 3 in which said gauge cutter is a rotatable disk having teeth on the circumference thereof each having a slanted lateral face positioned within a conical plane coaxial with the axis of rotation of the gauge cutter, and being disposed on the corresponding supporting member with said slanted lateral faces of said teeth at the radially outermost portion of each gauge cutter parallel with the axis of said main shaft.

5. A cutter head according to claim 3 in which said drag cutters are positioned on the respective supporting members closely adjacent to the site of said inclined side face of the rotary cutters and also closely adjacent to each other.

6. A cutter head according to claim 3 in which said acute angle $\theta$ is from 0.5° to 10°.

7. A cutter head according to claim 6 in which each of said teeth has an inclined side face positioned within a further conical plane coaxial with the axis of rotation of the disk, said side face being at an angle of 15°–45° relative to a plane perpendicular to the axis of rotation of said rotary cutter means.

8. A cutter head according to claim 6 in which said rotary cutter means each comprises a plurality of rotary cutters each having a disk and teeth on the circumference and freely rotatably mounted coaxially with each other.

* * * * *